United States Patent [19]

Laütenschläger, Jr. et al.

[11] Patent Number: 4,615,074

[45] Date of Patent: Oct. 7, 1986

[54] FOUR-JOINT CABINET HINGE HAVING AN ENLARGED OPENING ANGLE

[75] Inventors: Karl Laütenschläger, Jr., Reinheim; Gerhard Lautenschläger, Brensbach, both of Fed. Rep. of Germany

[73] Assignee: Karl Lautenschlager KG, Mobelbeschlagfabrik, Reinheim, Fed. Rep. of Germany

[21] Appl. No.: 690,648

[22] Filed: Jan. 11, 1985

[30] Foreign Application Priority Data

Feb. 15, 1984 [DE] Fed. Rep. of Germany ..... 3405343

[51] Int. Cl.[4] ..... E05D 15/32

[52] U.S. Cl. ..... 16/370; 16/386

[58] Field of Search ..... 16/368, 369, 370, 282, 16/288, 294, 380, 386

[56] References Cited

U.S. PATENT DOCUMENTS 4,368,559 1/1983 Oepping et al. ..... 16/370

4,499,631 2/1985 Lautenschlager ..... 16/370

FOREIGN PATENT DOCUMENTS 3407638 9/1984 Fed. Rep. of Germany ..... 16/370

*Primary Examiner*—Donald R. Schran

*Assistant Examiner*—James L. Wolfe

[57] ABSTRACT

Four-joint cabinet hinge of increased opening angle. In a four-joint cabinet hinge (10) with an opening angle of more than 105° the cup (14) that is provided as the door-related part and is to be fastened in a recess in the back of a corresponding door leaf is manufactured by the punch-press method from thin sheet steel. Different possibilities are described for the configuration and mounting of short pivot pins projecting from the inside wall of the cup and serving for the pivoting of the outer hinge link (16) on the door.

3 Claims, 13 Drawing Figures

FIG. 4
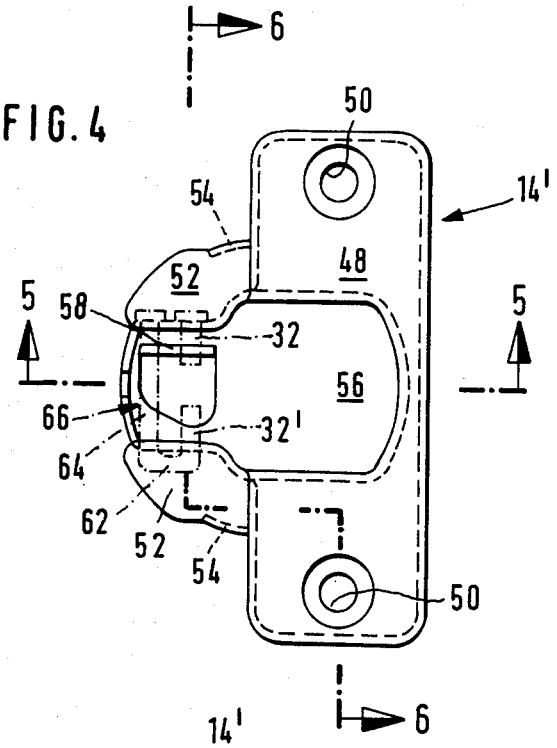
FIG. 6
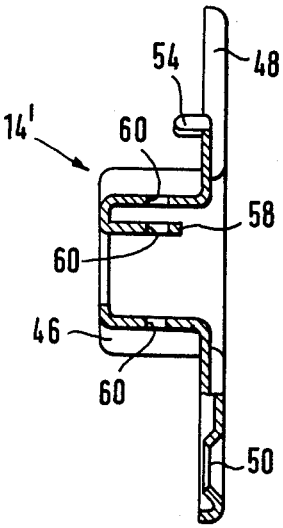
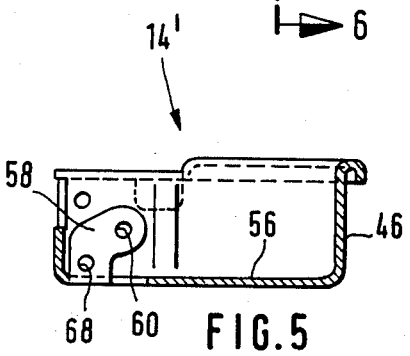
FIG. 5
FIG. 7
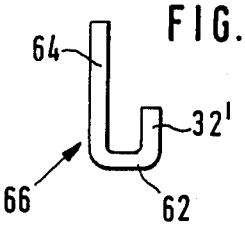
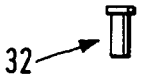
FIG. 8

FOUR-JOINT CABINET HINGE HAVING AN ENLARGED OPENING ANGLE

BACKGROUND OF THE INVENTION

The invention relates to four-joint cabinet hinges for door-opening angles of more than 105°. Such hinges have, as the carcass-related part, a supporting arm which can be adjustably fastened on a mounting plate previously installed on the supporting wall of a cabinet carcass. The door-related part is a cup which can be sunk and fastened into a recess in the back of the door leaf to be mounted on the carcass. These parts are coupled together by means of two hinge links each pivotally mounted at one end on the supporting arm and at the other in the cup on pivot pins held in the supporting arm and cup, respectively. The hinge link that is on the outside when such hinges are in the open position has pivot eyes formed on opposite longitudinal sides. In each of these eyes a short pivot pin projecting from the associated cup wall is engaged such that a free passage is left between the confronting ends of the pivot pins to accommodate the inner hinge link.

Such four-joint hinges of increased opening angle have in recent times been widely used in the manufacture of furniture, since they are only slightly more expensive than the formerly commonly used four-joint hinges which opened mostly to 90° or in any case no more than 105°, and which are of much simpler design and thus cheaper to manufacture than the so-called wide-angle crosslink hinges using a crossed link mechanism. On account of the cinematic conditions, the cup end of the outer hinge link cannot be mounted on a full-length pivot pin as in the older four-link hinges, because the inner hinge link passes through the cup-end pivot axis of the outer hinge link during the closing movement. It is for this reason that short pivot pins projecting from the wall of the cup and engaging the lateral pivot eyes on the cup end of the outer hinge link are used, which are fastened in the material of the cup; for this purpose the pivot pins are made larger than their bores in the cup, and they are press-fitted therein. To enable such press-fit mounting to be strong, the depth of the bores receiving one end of the short pivot pins must not be too shallow, i.e., they can be made only in cups having sufficient wall thickness in the area of the pivot-pin bores. This has been accomplished by making the cups by die-casting from a zinc alloy (Zamak), concentrating extra metal at the appropriate places. Making hinge parts of die-cast zinc alloy, however, involves a relatively high cost in the material and in the energy required for the casting process, so that an effort was made to produce such hinge parts as economically as possible by punch-pressing them from sheet steel. Consequently, hinge-mounting cups are increasingly being made more economically in this manner. However, the thickness of a cup made from sheet steel depends on the original thickness of the stock, and it is evident that the wall thickness of such a sheet metal cup will not suffice to hold pivot pins at only one end in bores in the wall. For this reason, four-link wide-angle hinges of the kind in question are still being manufactured only by the die-casting method.

Consequently, the invention is addressed to the problem of creating four-joint cabinet hinges for door-opening angles of more than 105°, which will be provided with a cup made by punch-pressing from sheet metal.

THE INVENTION

Setting out from a hinge of the kind described in the beginning, this problem is solved in accordance with the invention in the following manner: the cup is made in a known manner by the press-punch method from thin sheet steel and, of the pivot pins at the cup end, at least one of the short pivot pins engaging the pivot eyes of the outer hinge link is joined by a bridge adjoining this pivot pin and carried on the outside surface of the wall of the cup to a longer, pin-like side-leg running parallel at a distance which is passed through two aligned bores provided on opposite sides of the wall of the cup. The pivot pins thus configured are thus held not just in one corresponding bore in the wall of the cup, but additionally the second, parallel, pin-like side-leg is held in two additional bores, the length of this side-leg between the two bores holding it being great in comparison to the length of the portion of the actual pivot pin that is exposed within the cup interior. Thus it is basically possible by means of two pivot pins provided with additionally appended pin-like side-legs and inserted from opposite sides into the wall of the cup to produce a perfectly strong mounting of such short, projecting pivot pins even in hinge-mounting cups of thin sheet steel.

In a preferred further development of the invention, the longer, pin-like side-leg of one of the cup-end pivot pins is simultaneously made to serve as a pivot pin for the inner hinge link, i.e., it serves a dual purpose.

If the two pivot pins on which the outer hinge link is pivoted at the cup end are both provided with a parallel pin-like side-leg spaced away from them by a bridge, the side-leg of the second pivot pin must be offset from the side-leg of the first pivot pin, and then it is preferably passed through the interior of the cup close to the bottom of the latter.

In a further development of the invention, the cup-end pivoting of the outer hinge link can also be accomplished with only one pivot pin with a parallel side-leg added, this side-leg then, as mentioned previously, serving for the cup-end pivoting of the inner hinge link, while a simple, short pivot pin is used for the pivoting of the outer link; in this case the short pivot pin must be fastened in some other suitable manner in the cup so as to be sufficiently strong. In accordance with the invention, this is achieved by the fact that at least one tab is stamped from the material of the bottom of the cup and bent upwardly at right angles into the cup interior, and that this tab or tabs have a bore in alignment with the bores provided for the accommodation of the pivot pins for the cup-end pivoting of the outer hinge link and the end of an associated pivot pin projecting into the interior of the cup engages in that bore. The short pivot pins are then held at both their ends, each in a bore, namely the bore in the wall of the cup on the one hand and the bore in the tab on the other. Consequently, the bearing pressure or even shock loads exerted by the associated eye of the outer hinge link are introduced centrally between the ends of the pivot pin. It has been found that this kind of short pivot pin, press-fitted in bores at both of its extremities, can be fastened lastingly and strongly in hinge cups made of thin sheet steel.

Fundamentally, however, the problem to which the invention is addressed can be solved in hinges of the kind described above without the use of pivot pins provided with additional parallel side-legs, i.e., by means of simple, short pivot pins, if both of the pivot pins are fastened in the manner described above in a bore in the wall of the cup on the outside and in a bore in a tab on the inside. In one advantageous embodiment of the invention, this is accomplished by the fact that the portion of the wall of the cup facing the supporting arm when the hinge is open is formed from a section of sheet metal stamped from the bottom of the cup and bent upwardly at about 90°, from which two parallel tabs project at a distance from one another and from the cup wall into the interior of the cup, and that bores are likewise provided in the tabs in line with the bores for the pivot pins for the cup-end pivoting of the hinge links, and the inner ends of the pivot pins pivoting the cup end of the hinge links are held in those bores.

The invention is further explained in the following description of several of its embodiments given in conjunction with the drawings.

SUMMARY DESCRIPTION OF THE DRAWINGS

FIG. 4 is a top view of the cup of a first embodiment of a hinge of the invention;

FIG. 5 is a cross-sectional view seen in the direction of the arrows 5—5 in FIG. 4;

FIG. 6 is a cross-sectional view seen in the direction of the arrows 6—6 in FIG. 4;

FIG. 7 is a side view of a pivot element for the cup-end pivoting of the hinge links of a hinge of the invention;

FIG. 8 is a side view of a short pivot pin intended for the cup-end pivoting of the outer hinge link of the hinge of the invention;

DESCRIPTION OF PREFERRED EMBODIMENTS

Figure 1:
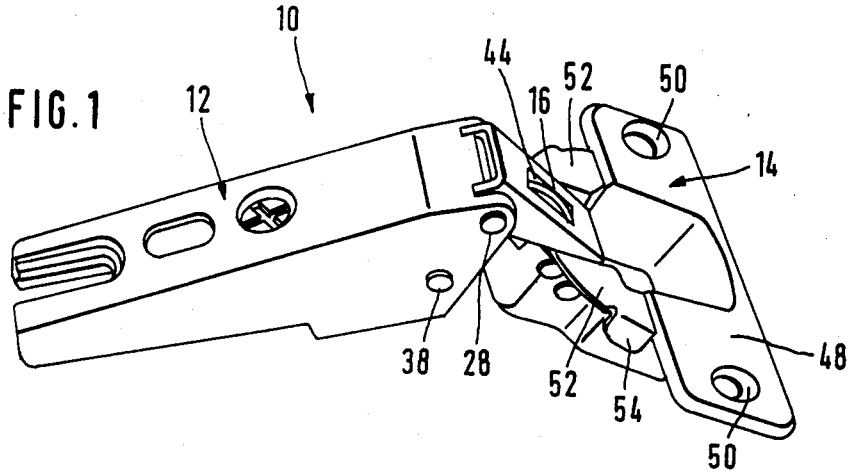
FIG. 1 is a perspective view of a four-joint cabinet hinge of increased door-opening angle, in the open state.
Figure 2:
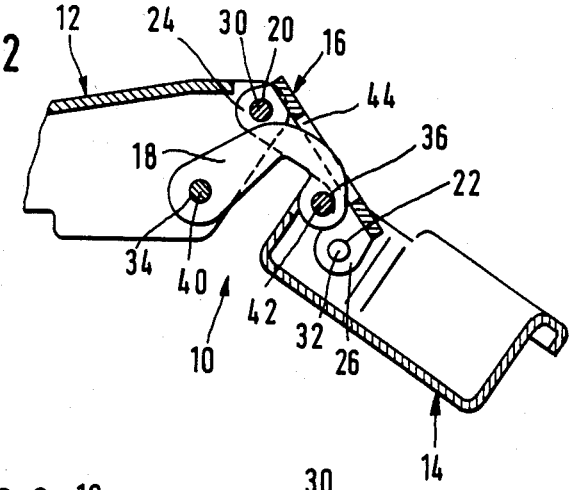
FIG. 2 is a longitudinal central section through the cup, the link and the front, door end of the supporting arm of the hinge shown in FIG. 1, in the open state.
Figure 3:
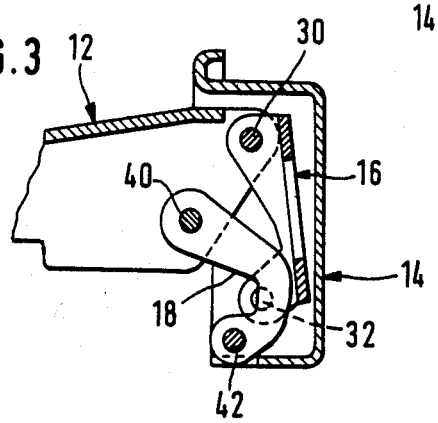
FIG. 3 is a cross-sectional view corresponding to FIG. 2, showing the hinge in the closed state.

The hinge of the invention, identified as a whole by the number 10, is a so-called four-joint hinge capable of opening to an angle of approximately 130° (FIGS. 1 and 2). The hinge 10 is composed of a supporting arm 12, which can be adjustably fastened to a mounting plate (not shown) previously installed on the supporting wall of a cabinet carcass, and which is of a channel-like configuration, and a cup 14 which can be sunk and fastened in a mortise in the back of a door leaf, these parts being coupled together by two hinge links 16 and 18 in a quadruple joint configuration, each link being pivoted at one end on the supporting arm 12, and at the other end on the cup 14, such that the cup 14, and with it a door leaf to which it is fastened, can be pivoted from the open state shown in FIG. 2 to the closed state shown in FIG. 3. The outer hinge link 16, which is visible in the open state, is in the form of an elongated rectangular strip of sheet metal having lug-like sections turned up at right angles on opposite longitudinal sides and forming pivot eyes 24 and 26 provided with aligned bores 20 and 22 at the supporting-arm end and cup end, respectively. By means of a full-length pivot pin 30 held in aligned bores 28 in the lateral cheeks of the supporting arm 12 and passing through the bores 20 in the hinge link 16, the hinge link 16 is pivoted on the supporting arm 12, while the pivoting of its other end within the cup 14 is accomplished by means of two short pivot pins 32 projecting from the inner surfaces of the cup and engaged each in one of the bores 22 of the hinge link 16. Between the confronting ends of the pivot pins 32, there thus remains an open space through which the inner hinge link 18, which is of correspondingly narrow dimensions, can pass as soon as the cup 14 approaches the closed state (FIG. 3). The inner hinge link 18, which is stamped from metal strip or plate material, and which is bent in the manner seen in FIG. 3, has in each end a bore 34 and 36, of which the bore 34 at the supporting-arm end contains a pivot pin 40 held in aligned bores 38 in the cheeks of the supporting arm 12, and the bore 36 in the cup end contains a pivot pin 42 held in aligned bores (not shown) in the wall of the cup 14. Up to this point the four-joint hinge described is known in itself, it being apparent that the opening angle, which is larger than it is in the conventional four-joint hinges which can be opened as far as 90°, or 105° at the most, is made possible by the fact that the cup-end of the inner hinge link 18, when the closed state is approached, can pass between the short pivot pins 32 projecting from the wall of the cup 14, which of course would not be possible if a full-length pivot pin were provided instead of the two pivot pins 32. Also to be noted in this connection is the window 44 which is visible in the outer link 16 and is punched approximately in the center of its rectangular back, and into which the central, curved section of the inner hinge link 18 can enter when the hinge is in the open state, so that inner hinge link 18 can retain the desired curved shape without any reduction of its central portion (see, U.S. Pat. No. 4,499,631).

What is novel and essential to the four-joint hinge 10 of increased opening angle in accordance with the invention is that the cup 14 is made by punch-pressing from sheet steel. In comparison with the cups made of cast metal, chiefly zinc die-casting alloy, which have been used exclusively heretofore for this application, this results in an important saving in costs. While the setting of full-length pivot pins in punch-pressed steel cups presents no difficulties, so that such cups are widely used for conventional four-joint hinges, the difficulty in achieving a sufficiently strong mounting of the short, projecting pivot pins 32 lies in the thin sheet metal wall. In the case of die-cast hinge cups, the wall thickness can be made sufficiently great in the area of the bore that is to receive these pivot pins 32, so that the latter will have sufficient strength when forced into the bores. In the case of hinge cups pressed from sheet metal, mounting the pins simply by press-fitting is not possible on account of the thinness of the cup wall. The addition of separate fastening means for the pivot pins 32, or their direct fastening to the cup by welding, however, would be too complicated and would nullify the cost reduction sought by avoiding the use of die-casting. For this reason, a number of possibilities are to be described below for designing hinge cups pressed from sheet metal in which the short pivot pins 32 will be given sufficient strength, on the one hand, and on the other hand will be able to be fastened in the hinge cup without special effort.

In the case of the hinge cup 14' stamped from sheet steel, which is shown in FIGS. 4 to 6, a different method of fastening each of the two short pivot pins holding the hinge link 16 at its cup end is represented, each method being, of course, also usable basically for both pins. The hinge cup 14' has an elongated, trough-shaped or tub-shaped portion 46 in which the hinge links 16 and 18 are pivoted, and which is fastened sunkenly in the corresponding mortise in the door leaf. The upper edge of portion 46 is adjoined by a marginal flange extending at right angles, a portion 48 of which is in the form of a mounting flange lying against the inside of the door leaf and having countersunk screw holes 50 for mounting screws which can be driven into the door material surrounding the mortise in the back of the door leaf, while the remaining portions 52 serve only to cover up the lateral gaps remaining in the door leaf alongside the trough-shaped or tub-shaped portion 46, and they are shaped accordingly. Guiding tabs 54 bent from the portion 52 at right angles in the direction of the trough-shaped or tub-shaped portion 46 center the cup 14' against lateral shifting in the mortise in the door.

A tab 58 is punched from the material of the bottom 56 of the trough-shaped or tub-shaped portion 46 and bent upwardly to a position parallel to and at a short distance from the upper sidewall (in FIGS. 4 and 6) of the trough-shaped or tub-shaped portion 46, so that a space corresponding approximately to the thickness of one of the pivot eyes 26 of the hinge link 16 will be left between the inside surface of the sidewall and the tab. Thus it is possible to provide aligned bores 60 in the sidewall of the trough-shaped or tub-shaped portion 46 and in the tab 58 for the short pivot pin 32 shown in FIG. 8, so that the pivot pin 32 will be fixed with a press-fit in the bores 60 on both sides of the pivot eye 26 after assembly of the hinge link 16. This method of fastening withstands all of the stresses occurring in hinges of the kind herein concerned.

Another method of fastening is shown in the case of the opposite short pivot pin 32'. In the manner represented in FIG. 7, this pivot pin 32' extends at right angles from a transverse portion 62, from the other end of which a longer pin-like portion 64 turns upwardly parallel to pivot pin 32' and is of such a length that, as represented in broken lines in FIG. 4, it can be passed through aligned bores in both opposite sidewalls of the trough-shaped or tub-shaped portion 46 and can then be locked in place, for example by upsetting the free end of portion 64; the transverse portion 62 then lies against the outer surface of the lower sidewall of the trough-shaped or tub-shaped portion. The sufficiently strong mounting of the pivot pin 32' in the cylindrical bore 60 in the associated lower sidewall of the trough-shaped or tub-shaped portion 46 is in this case achieved by combining the pivot pin 32 with the transverse portion 62 and side-leg 64 to form the side-leg pivot pin 66, the strength and rigidity being achieved by the fact that the side-leg 64, which is rigidly joined to pivot pin 32', is held at both ends in the sidewalls of the trough-shaped or tub-shaped portion 46.

It has proven to be especially desirable to use the pin-like side-leg 64 simultaneously as the pivot pin for the pivotal attachment of the inner link 18 at the cup end, i.e., the side-leg 64 then simultaneously functions as the pivot pin described in FIGS. 2 and 3 as a separate pivot pin 42.

Once again it is to be pointed out that the two methods described above for the mounting of the pivot pins 32 and 32' need not necessarily be combined in the manner described, and that they can be used individually for both of the short pivot pins. In the case of the use of short pivot pins 32, of the kind shown in FIG. 8, a second tab corresponding to the described tab 58 is to be provided adjacent the lower sidewall of the trough-shaped or tub-shaped portion 46.

Figure 9:
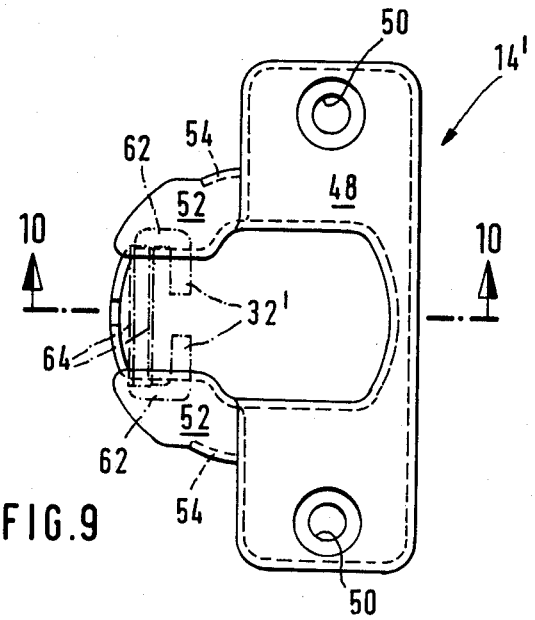
FIG. 9 is a top view of the cup of a second embodiment of a hinge in accordance with the invention.
Figure 11:
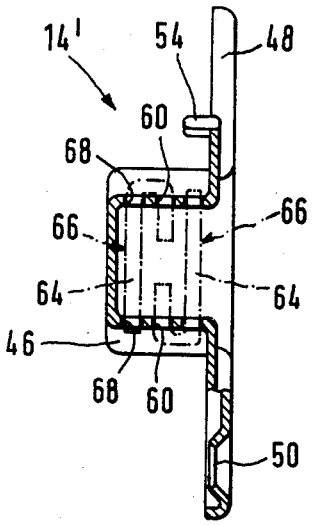
FIG. 11 is a view substantially the same as that of FIG. 6, of the second embodiment, but the section adjacent the bore for the pivot pins of the hinge links is made in the manner represented by the arrows 11—11 in FIG. 10.
Figure 10:
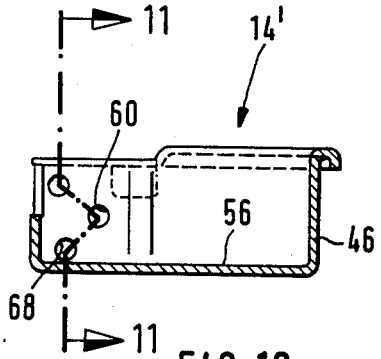
FIG. 10 is a side view seen in the direction of the arrows 10—10 in FIG. 9.

The other case, i.e., when one side-leg pivot pin 66 is mounted in each of the opposite sidewalls, and the tabs corresponding to tab 58 are entirely omitted, is represented in FIGS. 9 to 11, but then it is to be noted that only one of the side-legs 64 can be used simultaneously as the pivot pin for the cup end of the inner hinge link 18 while side-leg 64 of the second side-leg pivot pin 66 must be offset from side-leg 64 of the first integral pivot pin in order to pass through the interior of portion 46.

In FIG. 10, let it be assumed that the bore 68 represented in the lower part of the sidewall of the trough-shaped or tub-shaped portion 46 just above the bottom 56, and an aligned bore (not shown) in the opposite, cut-away sidewall of portion 46, serve to accommodate the side-leg 64 of the second integral pivot pin 66.

Figure 13:
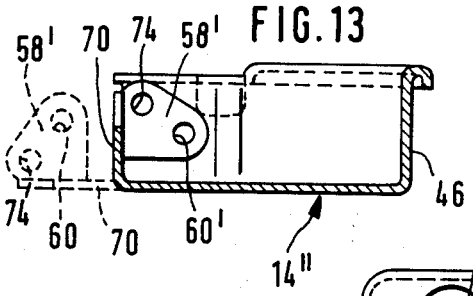
FIG. 13 is a cross-sectional view seen in the direction of the arrows 13—13 of FIG. 12.
Figure 12:
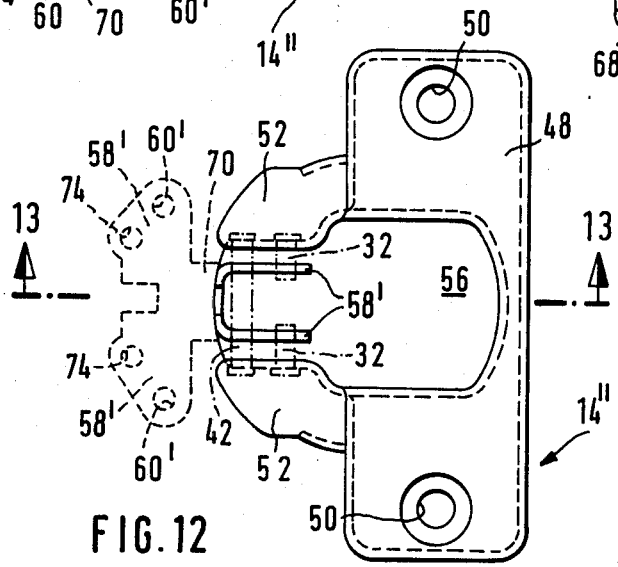
FIG. 12 is a top view of an alternative embodiment of a cup for a hinge in accordance with the invention.

In FIGS. 12 and 13 there is shown a modified embodiment of a hinge cup 14" press-punched from sheet metal for a hinge in accordance with the invention. The cup 14" corsponds in its general configuration to the cup 14' described above, equivalent parts of both cups also being provided with the same reference numbers. To avoid repetition, therefore, it will suffice to describe below only the modifications made with respect to the cup 14', leaving the rest to be found in the preceding description. In order to pivot the cup end of the outer hinge link 16 on two short pivot pins 32 of the kind shown in FIG. 8, tabs 58' are provided inside of the trough-shaped or tub-shaped portion 46, parallel to and at an appropriate distance from the inside surfaces of the sidewalls. These tabs 58' have bores 60' aligned with the bores 60 provided in the sidewalls for the accommodation of the pivot pins 32, and the confronting inner ends of the pivot pins 32 are held in these bores. Unlike the tab 58, however, the tabs 58' are not punched from the material of the bottom 56 and bent upwardly; instead, these tabs 58' are provided on a sheet metal section 70 which originally lies in the plane of the bottom 56 in the manner represented in broken lines in the figures of the drawing and which is stamped from the bottom and afterwards bent upwardly at 90°, and which then forms the portion of the wall of the trough-shaped or tub-shaped portion 46 which faces the supporting arm 12. It is clear that the tabs 58' cut in the sheet metal section 70, which initially lie in the plane of the bottom 56, have to be bent upwardly at 90° before the sheet metal section 70 is bent up (FIG. 13), so that they will be in the desired position parallel to the inside surfaces of the sidewalls of portion 46. The tabs 58', in the case of the cup 14", are made large enough to extend also over the area of the bores for the pivot pin 42 for the mounting of the cup end of the inner link 18. Accordingly, bores 74 are provided in the tabs 58' in line with the bores provided in the sidewalls of portion 46 for the pivot pin 42.

It is apparent that modifications and further developments of the embodiments described can be realized within the scope of the invention. Thus, also in the case of the hinge cup 14'' shown in FIGS. 12 and 13, side-leg pivot pins 66 can be used in the manner shown in FIG. 7 instead of separate short pivot pins 32 and a longer pivot pin 42.

We claim:

1. A hinge for use in a cabinet and capable of opening angles of more than about 105° between an open position and a closed position, comprising:

a carcass-related part forming a supporting arm, for fastening on a mounting plate on a wall of a cabinet, a door-related part forming a cup of thin sheet metal, to be sunk in a recess in a door leaf of a cabinet, and having two opposite cup walls, a first hinge link having one end adjacent said supporting arm, and a second end in said cup, said first hinge link being provided at least at said second end thereof, with two opposite side walls, a second hinge link having one end adjacent said supporting arm, and a second end in said cup between said side walls, first pivot means pivotally connecting said one ends of said two links to said supporting arm, and second pivot means pivotally connecting said other ends of said two links to said cup, and including two relatively short pivot pins extending through aligned bores in said cup walls and in said side walls from outside said cup into the interior of the cup, at least one of said pins having a relatively long leg extending across said cup through aligned bores in said two cup walls and in said two side walls, and an intermediate leg connecting said long leg to said at least one pin and extending outside one of said cup walls, said cup having a bottom, at least one tab punched from the material of said bottom and extending at right angles into the interior of the cup, said at least one tab having a bore in alignment with bores in said cup walls and in said side walls, one of said pivot pins projecting into the interior of the cup being engaged in said bore in said tab.

2. A hinge according to claim 1, wherein said long leg forms a pivot of said pivot means for connecting said second link to said cup.

3. A hinge for use in a cabinet and capable of opening angles of more than about 105° between an open position and a closed position, comprising:

a carcass-related part forming a supporting arm, for fastening on a mounting plate on a wall of a cabinet, a door-related part forming a cup of thin sheet metal, to be sunk in a recess in a door leaf of a cabinet, and having two opposite cup walls, a first hinge link having one end adjacent said supporting arm, and a second end in said cup, said first hinge link being provided at least at said second end with two opposite side walls with two pairs of aligned bores, a second hinge link having one end adjacent said supporting arm, and a second end in said cup between said side walls, first pivot means pivotally connecting said one ends of said two links to said supporting arm, and second pivot means pivotally connecting said other ends of said two links to said cup, and including two relatively short pivot pins extending through aligned bores in said cup walls and in said side walls from outside said cup into the interior of the cup, said cup having a bottom with a section bent upwardly at about 90°, from which two parallel tabs spaced apart from one another and from the cup walls project into the cup interior, bores in said tabs in alignment with said bores in said cup walls and in said side walls for said short pivot pins, said pivot pins having inner ends received in said bores and pivotally supporting said first link.

* * * * *